United States Patent [19]

Heyer et al.

[11] Patent Number: 4,486,200

[45] Date of Patent: Dec. 4, 1984

[54] METHOD OF MAKING AN ABRASIVE ARTICLE COMPRISING ABRASIVE AGGLOMERATES SUPPORTED IN A FIBROUS MATRIX

[75] Inventors: Raymond F. Heyer; William R. Lovness, both of Saint Paul, Minn.

[73] Assignee: Minnesota Mining and Manufacturing Co., Saint Paul, Minn.

[21] Appl. No.: 416,366

[22] Filed: Sep. 9, 1982

Related U.S. Application Data

[62] Division of Ser. No. 186,470, Sep. 15, 1980, Pat. No. 4,355,489.

[51] Int. Cl.[3] ..... B24B 1/00

[52] U.S. Cl. ..... 51/295; 51/400

[58] Field of Search ..... 51/400, 395, 402, 398, 51/297, 295

[56] References Cited

U.S. PATENT DOCUMENTS

| | | | |
|---|---|---|---|
| 2,216,728 | 10/1940 | Benner et al. . | |
| 2,284,715 | 6/1942 | Benner | 51/400 |
| 2,958,593 | 11/1960 | Hoover | 51/400 |
| 2,986,455 | 5/1961 | Sandmeyer . | |
| 3,048,482 | 8/1962 | Hurst . | |
| 3,127,253 | 3/1964 | Smith | 51/293 |
| 3,377,151 | 4/1968 | Lanham | 51/400 |
| 3,871,139 | 3/1975 | Rands . | |
| 3,955,324 | 5/1976 | Linstrom . | |
| 3,982,359 | 9/1976 | Elbel . | |

FOREIGN PATENT DOCUMENTS

| | | | |
|---|---|---|---|
| 230115 | 7/1959 | Australia | 51/400 |

*Primary Examiner*—Harold D. Whitehead

*Attorney, Agent, or Firm*—Donald M. Sell; James A. Smith; Richard Francis

[57] ABSTRACT

An abrasive article comprising a plurality of separated abrasive agglomerates distributed within a matrix of undulated filaments is provided. The invention also provides a method of making an abrasive article comprising forming, within a lofty open web comprising undulated filaments bonded at points of mutual contact, a plurality of separated abrasive agglomerates to provide an abrasive agglomerate-impregnated web. Articles may be prepared of the agglomerate-impregnated web per se or by laminating layers of the web together preferably under pressure. Exemplary articles include abrasive wheels, discs, belts, sheets, blocks and the like.

3 Claims, 7 Drawing Figures

METHOD OF MAKING AN ABRASIVE ARTICLE COMPRISING ABRASIVE AGGLOMERATES SUPPORTED IN A FIBROUS MATRIX

This is a division of application Ser. No. 186,470 filed Sept. 15, 1980 and now U.S. Pat. No. 4,355,489 issued Oct. 26, 1982.

FIELD OF THE INVENTION

The invention relates to an abrasive article comprising a plurality of separated abrasive agglomerates distributed within a matrix of undulated filaments and to a method of making the same.

BACKGROUND ART

Abrasive tools come in many types, each generally designed for specific applications and no one type providing a universal abrading tool for all applications. The various types of abrading tools include, for example, coated abrasives, i.e., abrasive granules generally uniformly distributed over and adhered to the surface of a flexible backing; grinding wheels, i.e., abrasive material consolidated together in a mass in the form of a rotatable annulus; and low density abrasives, i.e., an open, lofty, three-dimensional fiber web impregnated with adhesive which does not alter the open character of the web and also adheres abrasive granules to the web.

While low density-type abrasive products have enjoyed considerable commercial success as metal, wood and plastic finishing tools, there are two areas in which this type of abrasive tool has had limited success because of its inability to achieve a high cut rate and/or to produce a level surface having a uniform scratch depth on the surface being abraded. Surfaces finished with low density abrasive typically exhibit a matte finish characterized by a non-uniform pattern of relatively deep and shallow scratches and not a polished, glossy finish. Thus, low density abrasive products have generally not been used in applications which require the production of surfaces which are buffable to a mirror-like finish similar to that which is produced by buffing and electroplating. Presently, the major portion of these tasks are accomplished by the use of coated abrasive belts or abrasive set up wheels, both of which have disadvantages.

A coated abrasive belt has a very high initial cut rate and produces a high surface roughness when new, but each of these properties drops off very rapidly with use. Coated abrasive belts also provide a very limited degree of conformability because of the manner in which they are supported in the abrading machine, limiting their use on complex surfaces. Soft back up wheels of various types are used with coated abrasives but the restricted stretchability of the coated abrasive backing limits the conformability of the belt.

Set up wheels are generally constructed from a stack of cotton discs which are compressed to a desired firmness and sewn together. The edge of the disc is then coated with an adhesive such as animal hide glue or a synthetic resin and, while the adhesive is still wet, the wheel is rolled through a bed of abrasive mineral and allowed to dry to provide an abrasive coating as a hard shell. This operation may be repeated to provide several layers. Drying is customarily done under controlled temperature and humidity conditions over several days for optimum results. When dried, the hard shell is cracked by repeated blows until it is conformable.

While the resultant wheel has an acceptable cut rate and produces a desirable finish throughout its life, it has a number of disadvantages. A major disadvantage is the fact that the abrasive mineral is only present as a thin layer on the peripheral surface of the wheel, rather than existing throughout the wheel. Thus, when one area of the wheel's abrasive surface wears away, the entire abrasive coating must be replaced to produce an adequate abrasive product. Set up wheels are also very sensitive to use modifications by particular operators and may also be affected by changes in humidity, particularly if moisture-sensitive adhesives such as hide glue are employed.

While several attempts have been made to produce abrasive products to replace coated abrasive products and set up wheels for the aforementioned two applications or for other purposes, they have generally been not without disadvantage. The following is illustrative of the prior art in this regard.

U.S. Pat. No. 3,982,359 (Elbel) describes an abrasive wheel comprised of abrasive grain rigidly bonded together in aggregates which are then bonded in a resilient elastomeric matrix where the aggregates do not interfere with each other during movement under grinding conditions.

U.S. Pat. No. 2,216,728 (Benner et al.) describes bonding together aggregates composed of bonded abrasive particles to form a dense abrasive article.

U.S. Pat. No. 2,986,455 (Sandmeyer) discloses abrasive articles made with an abrasive component in the form of a hollow spherical or globular abrasive particle held together in a bonding matrix.

U.S. Pat. No. 3,048,482 (Hurst) discloses forming an abrasive article from a multiplicity of individually rigidly bonded abrasive bodies mounted or supported in a surrounding resilient matrix or reticulum in such a way that the rigid abrasive bodies can be described as being hinged to the ribs of the reticulum.

U.S. Pat. No. 3,871,139 (Rands) discloses a rotary abrasive hone made of multiple outwardly extending plastic bristles having enlarged abrasive globules firmly attached to the outer ends of the bristles.

U.S. Pat. No. 3,955,324 (Lindstrom) discloses a grinding tool comprised of abrasive agglomerates consisting of abrasive grains embedded in a metal phase and the agglomerates embedded in a synthetic resin.

DISCLOSURE OF INVENTION

The present invention provides an abrasive article comprising a matrix comprising undulated filaments bonded together at points of mutual contact and a plurality of separated abrasive agglomerates movable with respect to one another and distributed within the matrix and to a method of making the same. By the phrase "distributed within the matrix", we mean that a major portion of the volume of each of the agglomerates is situated within or inside the matrix, while a minor portion of the volume of each agglomerate may extend outside the matrix. The abrasive agglomerates have a minimum size of about 2 mm and comprise abrasive particles bonded together with a bonding agent to provide an abrasive particle to bonding agent weight ratio of about 1:1–20:1. The matrix is characterized by having spaces between the filaments preferably to provide voids on the order of 70% to 97% by volume.

The method of making the abrasive article comprises forming within a lofty open web comprising undulated filaments bonded at points of mutual contact a plurality of separated abrasive agglomerates to provide an abrasive agglomerate-impregnated web wherein said abrasive agglomerates comprise abrasive particles bonded together with a bonding agent to provide an abrasive particle to bonding agent weight ratio of about 1:1–20:1. The preferred method of forming the agglomerates within the web involves depositing a pattern of spaced agglomerates formed of a mixture of liquid bonding agent and abrasive granules with an appropriate printing or extruding device and curing the agglomerates. The preferred method of making an abrasive wheel involves convolutely winding a strip of agglomerate-impregnated web impregnated with a liquid binder such as a liquid foamable organic binder and permitting the foam to expand and cure. An alternative method of making the abrasive article of the invention comprises forming the separated abrasive agglomerates in a lofty, open, nonwoven web of undulated organic filaments, cutting segments of the agglomerate-bearing web to a desired size, stacking the cut segments to form an assembled pile of segments, compacting the pile together under pressure, and adhering the compacted pile together in a manner which permits retention of the compacted shape after removal of pressure, and removing the compacting force.

The abrasive articles as thus described may be formed into any of a variety of useful shapes, preferably into wheels, to provide useful abrasive products. Unlike set up wheels the abrasive products of the present invention contain abrasive material throughout, permitting their use for much longer periods of time without application of a surface coating of abrasive material as in the case of set up wheels. Furthermore, the abrasive product of the present invention may be prepared in a wide variety of structures to provide conformability varying from substantially non-conformable to very conformable, depending upon the composition of the fibrous matrix.

Most significantly and unexpectedly, the abrasive product of the present invention has the ability to level the surface being treated, i.e., to provide a more uniform surface as typically found on the surface of substrates which have been treated with lofty, nonwoven abrasive products. While not wanting to be bound by theory, it is surmised that the leveling action is a result of the relatively large abrasive agglomerates which wear away to a surface which corresponds to the surface of the workpiece and which tend to "float" in the fibrous matrix, permitting them to respond to the surface being treated en masse unlike smaller agglomerates or individually supported abrasive granules that are typically dispersed throughout nonwoven abrasive products.

DESCRIPTION OF THE DRAWING

The invention is further illustrated by reference to the accompanying drawing wherein.

DETAILED DESCRIPTION

Figure 1:
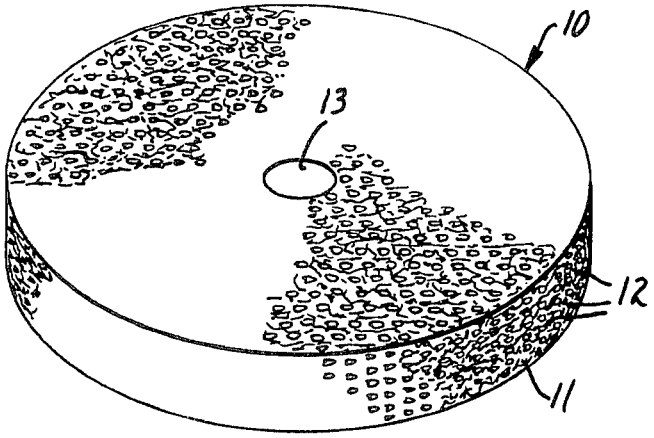
FIG. 1 is a perspective view of an abrasive wheel made in accordance with the present invention.

Referring now to FIG. 1, there is shown an abrasive article in the form of wheel 10 comprising a fibrous matrix 11 comprising undulated filaments bonded at points of mutual contact and a plurality of separated abrasive agglomerates 12 preferably uniformly distributed within matrix 11. Matrix 11 is characterized by having open spaces between filaments to provide a porous supporting structure of a predetermined resiliency to provide an appropriate support for agglomerates 12. Wheel 10 preferably has an opening 13 suitable for mounting for rotation on a suitable arbor, not shown. Abrasive agglomerates 12 comprise abrasive particles bonded together with a bonding agent to provide an abrasive particle to bonding agent weight ratio on the order of 1:1–20:1.

Figure 5:
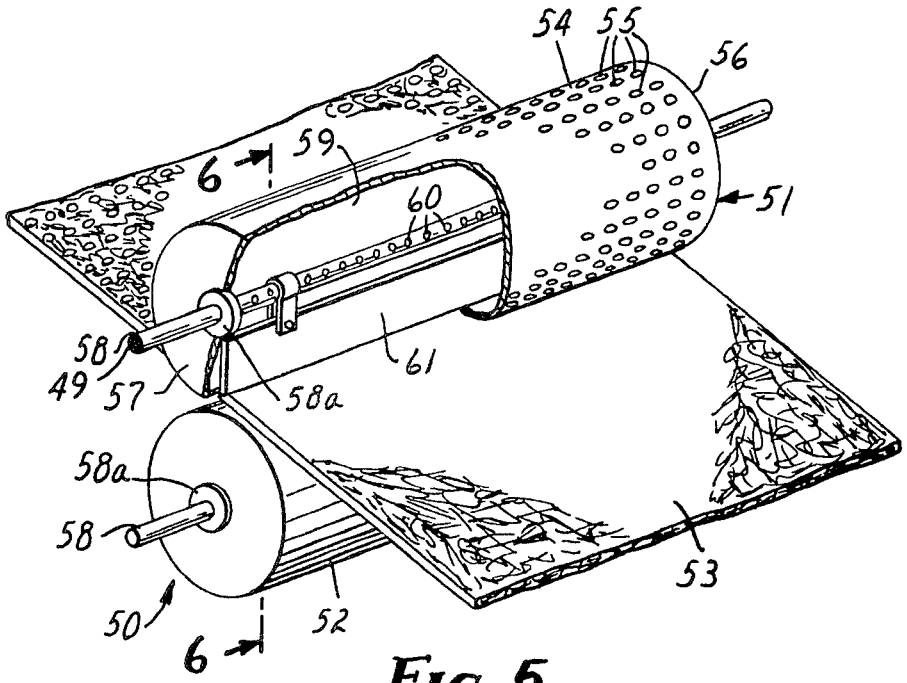
FIG. 5 is a perspective schematic view, with parts cut away to show detail, of the preferred process and equipment for producing the abrasive article of the invention.
Figure 6:
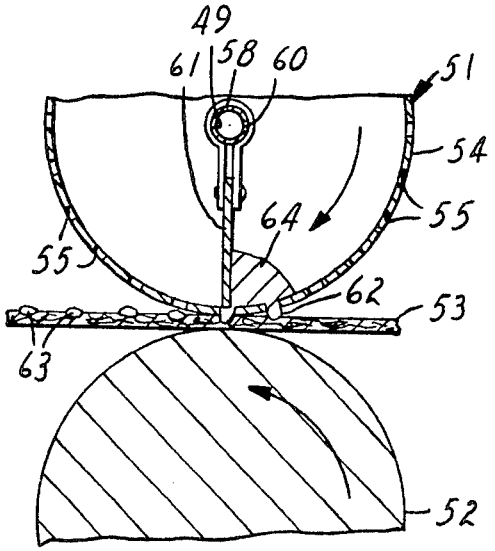
FIG. 6 is a cross sectional view of the equipment of FIG. 5 taken at Line 6—6.

FIGS. 5–6 show a preferred apparatus 50 for creating agglomerates within a fibrous matrix 53. Apparatus 50 includes perforated hollow roll 51 and back-up roll 52, each supported for rotation in opposite directions on suitable shaft 58 preferably having bearings 58*a* on either end and longitudinally aligned and positioned in close proximity so as to slightly compress and draw fiber web 53 therebetween. Roll 51 has a perforate cylindrical wall 54 characterized by having a multiplicity of openings 55 which are of a size which will permit the passage of a mixture of liquid binder and abrasive granules and closed ends 56 and 57. A conduit 49, e.g., provided within shaft 58 which may be hollow, of a size and shape capable of permitting the passage of a mixture of liquid bonding agent and abrasive granules is positioned into roll 51 to provide a mass 64 of the mixture within inner chamber 59. A means such as a fluid displacement pump (not shown) forces such a mixture through conduit 49 preferably through spaced openings 60 into chamber 59. Doctor blade 61, mounted in fixed position within roll 51 on shaft 58, is held in fixed position and roll 51 and back-up roll 52 are rotated in the direction shown thereby causing the mixture of liquid bonding agent and abrasive granules to be extruded from openings 55 and the extruded segments 62 are forced from the roll by the doctor blade as the extruded segments contact web 53, leaving agglomerates 63 within web 53.

Figure 2:
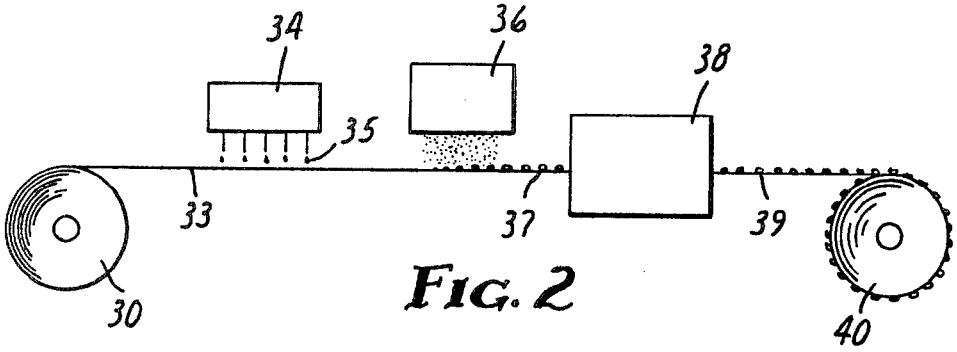
FIGS. 2–4 schematically illustrate a process for producing the abrasive article of the invention.
Figure 3:
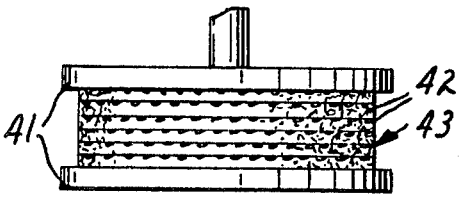
Figure 4:
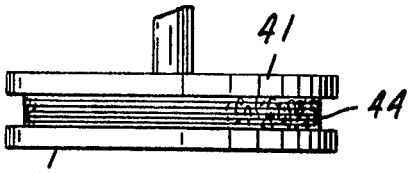

Referring now to FIGS. 2–4, there is shown an alternative process for producing the abrasive article of the present invention. As shown in FIG. 2, a mat or web of filaments is drawn from supply roll 30 and is directed beneath dropping device 34 which is designed to deposit droplets 35 of liquid resin into web 33 and the coated web is then passed beneath coating station 36 where abrasive granules are applied to provide agglomerate-impregnated web 37 which is then passed through curing oven 38 to provide cured agglomerated-coated web 39 which may be wound on storage roll 40 for future conversion or may be cut to provide appropriate segments for formation into various structures as will hereinafter be described.

Figure 7:
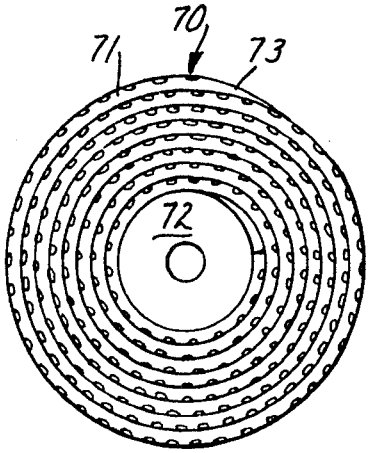
FIG. 7 is a side view of a convolutely wound abrasive wheel made in accordance with the present invention.

Preferably, an abrasive wheel 70 of the type shown in FIG. 7 may be produced by convolutely winding a strip 71 of agglomerate-impregnated web on a suitable centrally bored core 72, restraining the wound shape, bonding the restrained shape, e.g., with liquid curable adhesive, curing the adhesive and preferably dressing strip end 73, e.g., by skiving, or by dressing the entire wheel to make a nearly perfect circular edge. Alternatively, a wheel may be produced as shown in FIGS. 3–4 by cutting disc-shaped segments 42 of the coated web 39 and collecting segments 42 to provide stack 43 which is uniformly coated with a limited amount of a binder resin and then interposed between the surfaces of a press 41 wherein stack 43 is permanently compressed and consolidated to provide wheel 44. Thereafter, the peripheral surface of wheel 44 may be dressed and a mounting hole 13 may be provided. Alternatively, cured agglomerate-coated web 39 may be cut into larger sized segments, the segments after that are uniformly coated with a limited amount of binder resin and stacked and the stack compacted, as described above, to provide a block from which one or more wheels or other abrasive articles may be cut, depending upon the size of the block and the size of the wheels or other abrasive articles.

These and other means may be employed to make other abrasive articles including discs, sheets, blocks, belts and the like. An abrasive disc, sheet or belt may be made by cutting a single sheet of agglomerate-impregnated web or by laminating one or more such sheets to a thin flexible backing such as a fabric sheet.

The web forming the fibrous or filamentous matrix may be formed of any suitable material capable of withstanding the processing and use conditions as herein described. The preferred materials for the filaments of the matrix include organic materials such as nylon, polyester, (e.g., polyethylene terephthalate), and the like, natural fibers such a hemp, jute, cotton, hair, sisal and the like. The filaments may also be formed of inorganic materials such as metal, ceramic, or a combination of two or more of the above. The fibers may be staple or continuous and are undulated to provide a lofty, open, three-dimensional structure when laid into a mat. Such undulations may be provided by crimping, coiling, kinking, or otherwise bending the fibers or filaments from a straight deployment to obtain such a lofty, open structure.

The filaments or fibers of the fibrous matrix may be autogenously bonded together or they may be adhesively bonded together with a suitable curable initially liquid adhesive composition. In some cases thermoplastic filaments may be autogenously bonded merely by pressing, caused by cold flow fusion between adjacent compressed fibers and perhaps the generation of some heat at these points under the applied pressure. The preferred liquid curable bonding resin for bonding the fibers of the fibrous matrix together is a polyurethane prepolymer binder available under the trade designation "Adiprene" BL-16. Other useful binding resins include phenolic resins, epoxy resins, acrylic resins, isocyanurates, and the like. The binder should be selected so that when cured it is not excessively brittle or friable to cause the matrix to fail under the use conditions contemplated. The binder should be sufficiently strong to provide a strong adherent bond between the filaments to provide structural integrity to the matrix, yet it should not be so stiff or rigid or applied in such quantities as to interfere with the resiliency of the matrix and thus not provide the floating action for the abrasive agglomerates.

The filaments may have a cross-section which is round, square, triangular, rectangular or a blend of various cross-sections. The web which may be processed as described to form the matrix preferably is an integral web such as may be provided by a nonwoven web formed with a web-forming machine such as that sold under the trade designation "Rando-Webber", or it may be provided by weaving, knitting, winding, extruding thermoplastic material, as described for example in Hennen and Kusilek (U.S. Pat. No. 3,837,988), or other means.

The preferred webs are nonwoven webs formed of nylon or polyester thermoplastic organic filaments having a size on the order of 3 to 500 denier and a web thickness in the range of 2 to 50 mm.

The abrasive agglomerates are characterized by being separate, i.e., having distinct lines of separation although adjacent agglomerates may touch one another.

The abrasive agglomerates are characterized by comprising abrasive granules or grain bonded together in a solid mass with a substantially rigid bonding agent. Virtually any bonding agent typically employed in the formation of grinding wheels to bond the abrasive mineral together may be employed. Typical examples of binders which are found to be useful include the glasses commonly used in vitified wheels and natural or synthetic resins commonly used in resin-bonded grinding wheels. The preferred bonding agents are organic materials such as phenolic resins, ureaformaldehyde, shellac, epoxy resins, isocyanurates, polyurethane, animal hide glue, and the like.

The abrasive granules or grain may be any of a wide variety of known abrasive materials such as aluminum oxide, silicon carbide, garnet, emery, diamond, or mixtures of these. The particle size of the abrasive granule will, of course, be dictated by the particular application and may vary from relatively fine, e.g., 10 microns average particle size, to relatively coarse, e.g., 100 microns average particle size.

The optimum size and shape of the individual abrasive agglomerates will depend somewhat on the dimensions of the abrasive wheel or other abrasive article. Larger size wheels may have larger size abrasive agglomerates. The preferred agglomerate size will be on the order of 2 to 15 mm in average diameter for abrasive wheels having a diameter on the order of 25 to 500 mm.

The amount of abrasive grain in the agglomerate may be expressed as the weight ratio of the abrasive grain to the bonding agent and preferably is on the order of 1:1–20:1. The weight ratio will, of course, vary with the particle size of the abrasive grain and the amount of binder employed should be selected to optimize the effect of the abrasive grain in use. That is, the amount of bonding agent selected should be an amount which is a minimum amount consistent with obtaining good bonding of the particles. Increasing the amount of bonding agent beyond this amount would tend to obscure the abrasive grain and perhaps cause smearing of the article being treated with bonding agent, if the bonding agent is a synthetic resin.

On a volume basis of the abrasive article, the preferred ratio of abrasive agglomerates to matrix is on the order of 1:20–3:1. At substantially higher volumes of agglomerates, the abrasive article is somewhat stiff and rigid, like a grinding wheel.

The abrasive agglomerates may contain the usual additives which improve performance when incorporated into rigidly bonded wheels. Such additives include pyrite, cryolite, potassium fluoborate, and the like.

The agglomerates may be introduced into the matrix in any of a variety of ways. A convenient way to deposit spaced agglomerates on a nonwoven web is depicted in FIG. 2. Under these conditions, it is preferred that the agglomerate bonding agent be a controlled viscosity liquid which will penetrate at least partly into the web to provide anchoring therein and be receptive to impregnation by abrasive particles. Similarly, a viscous slurry consisting of at least partially uncured bonding agent and abrasive grain may be introduced within the web or fibrous structure, e.g., by intermittent extrusion processes or by other means. Another convenient way of introducing the agglomerates into the web involves first introducing minute segments of resin-impregnated or resin-coated carrier materials such as bits of paper or cloth impregnated with a tackifiable uncured bonding agent. Such bits may be introduced while the bonding agent is in a somewhat nontacky state and, by application of a suitable tackifying agent, e.g., solvent or heat, the bits may be rendered tacky and abrasive grain applied until the bits become coated on all sides with abrasive grain whereafter a suitable sizing adhesive may be applied. Other ways of introducing the agglomerates into the web will become apparent to those skilled in the art once apprised of the invention as herein disclosed.

The abrasive agglomerates may also be introduced into the matrix by introducing a continuous layer or plurality of strips of a liquid or semi-liquid mixture of abrasive grain and bonding agent within the matrix, curing the bonding agent and fracturing the resultant structure to provide a plurality of abrasive agglomerates as herein defined.

The abrasive articles of the present invention may be further reinforced by impregnation of the matrix with an elastomeric reinforcing agent, preferably a foamed polymeric reinforcing agent such as a one-shot polyether flexible polyurethane foam. Other polymeric elastomers and foams may also be useful. Other modifications are possible without departing from the scope of the claims.

The following examples are further illustrative of the invention. All parts and percentage values are by weight unless specifically stated otherwise.

EXAMPLE 1

A coating composition consisting of 43 parts of a 3:1 solution of methanol:polyamide (available under the trade designation "Elvamide" No. 8063 from the Du-Pont Company) and 57 parts of a resin composition consisting of 74% non-volatile base-catalyzed phenol-formaldehyde resin was knife coated onto one side of 0.08 mm thick Kraft paper to provide a dry coating thickness of 0.13 mm after heating for 3 minutes at 62° C., 3 minutes at 50° C. and 3 minutes at 95° C. The opposite side of the paper was knife coated in the same manner and with the same composition to provide a 0.1 mm dry coating. The coated paper was then cut into 6 mm squares and a multiplicity of such squares were introduced into a "Rando-Webber" web forming machine with crimped 38 mm staple nylon fibers consisting of 90% 50 denier fibers and 10% 15 denier fibers. The crimped fibers and coated paper squares were formed by the web forming machine into a web weighing 165 g/m$^2$ with the flakes being distributed throughout the web and covering about two-thirds of the area of the web.

The flake-bearing web was then roll coated with methanol to soften the paper coating and cause the flakes to conform to the fiber surfaces and dried at 65° C. in a hot air oven to bond the flakes to the fibers. The resultant web was then again roll coated with methanol to make the adhered flakes tacky and the web was then passed under a mineral dropping device and 120 grit aluminum oxide mineral (average particle size 125 microns) was dropped into the web and permitted to adhere to the surface of the resin-coated flakes. A rotating beater bar in contact with the paper carrier caused the abrasive particles to be coated on all sides of the resin-coated paper flakes and the web was again passed through the oven at 95° C. and thereafter spray coated with a size resin coating composition consisting of 890 parts diethylene glycol monoethyl ether (available under the trade designation "Carbitol"), 600 parts 74% non-volatile base-catalyzed phenol formaldehyde resin and 120 parts 50% aqueous sodium hydroxide solution. The resultant size-coated web was then passed into a curing oven heated at 150° C. for 3 minutes. The web was then spray coated with the same size resin coating composition on the opposite side and cured at 150° C. for 3 minutes. The resultant product contained 800 g/m$^2$ abrasive and 235 g/m$^2$ size resin (dry weight).

Testing

The abrasive product according to the invention described in Example 1 was evaluated for abrasiveness employing a Schiefer tester against 3 control devices, identified as "Control 1", "Control 2", and "Control 3", as hereinafter described. "Control 1" consisted of a simulated abrasive set up wheel formed by coating a, hereinafter referred to as "Bonded Nonwoven Web*" on one side with a set up wheel adhesive composition (available under the trade designation "Grip Master" cement from the Lea Co. composed of 8% gum arabic, 52% siliceous clays, 3% water and a small amount of lubricant) to provide a 0.5 mm (when dry) continuous layer on one side of the web.

*Bonded Nonwoven Web. Fibers consisting of 90% by weight 50 denier and 10% by weight 15 denier 40 mm long crimped nylon staple fibers were air laid with a Rando-Webber machine to provide a web which weighed 167 g/m$^2$. The web, carried on a paper backing, was roll coated with a resin binder consisting of 60 parts ketoxime-blocked poly-1,4-butylene glycol diisocyanate having a molecular weight of about 1500 (available under the trade designation "Adiprene" BL-16), 7.3 parts methylene dianiline and 32.3 parts 2-ethoxy ethyl acetate solvent (available under the trade designation "Cellosolve" acetate). The resin-coated web was cured by heating at a web speed of 5 m/min in an 18 meter, 2-zone oven having a first zone heated at 130° C. and the second zone heated at 140° C. (equal length zones) to provide 9 mm thick web having a dry resin add on weight of 84 grams per m$^2$.

The adhesive-coated side of the web was then dipped into 120 grit (125 micron average particle size) aluminum oxide abrasive mineral and the coating air dried to provide a 2 mm thick abrasive coating. The same surface was again coated with the set up wheel adhesive composition and additional mineral added as described above and the coating allowed to air dry. The abrasive-coated web was then die cut into a 100 mm diameter disc and the abrasive surface of the disc was fractured by hammering to produce discrete abrasive agglomerates connected together by the fibrous web. It should be noted that a set up wheel is customarily utilized on its peripheral surface, but the Schiefer test is designed to test the abrasiveness of a disc-shaped abrasive article, rather than the peripheral edge of an abrasive wheel. This format of simulating the set up wheel was therefore adopted.

"Control 2" consisted of a 100 mm diameter disc of 120 grit (125 micron average particle size) coated abrasive sheet material (commercially available from the assignee of the present application under the trade designation 3M Brand "C" type disc) consisting of alumina abrasive grain adhered to a flexible vulcanized fiber backing.

"Control 3" consisted of a 100 mm diameter disc of nonwoven abrasive material commercially available from the assignee of the present application under the trade designation "Scotch-Brite" brand Cutting and Polishing material containing 180 grit (85 micron average particle size) aluminum oxide abrasive material bonded within an open, lofty, fibrous web of nylon filaments.

The test involved placing a 100 mm diameter test abrasive article in the Schiefer tester against a 100 mm diameter 2 mm thick steel test disc with a load of 4.5 kg applied between the test disc and the steel disc while rotating the abrasive disc at about 150 rpm and rotating the steel disc in the same direction at the same rate with the centers of rotation being setoff 25 mm. Each test abrasive disc was permitted to go through 14 cycles of 3000 revolutions each with the weight lost from the steel plate being recorded after each cycle. Results are shown in Table I below. It will be noted that the cut rate, i.e., the weight lost from the steel test panel in grams, was significantly higher with the abrasive product of the present invention throughout the entire 14 cycles.

TABLE I

| Cycle No. | Weight Loss (g) | | | |
|---|---|---|---|---|
| | Example 1 | Control 1 | Control 2 | Control 3 |
| 1 | 1.64 | 1.3 | 0.36 | 0.25 |
| 2 | 1.36 | 1.09 | 0.58 | 0.11 |
| 3 | 1.14 | 0.96 | 0.65 | 0.10 |
| 4 | 0.9 | 0.62 | 0.38 | 0.11 |
| 5 | 0.9 | 0.45 | 0.65 | 0.15 |
| 6 | 0.92 | 0.32 | 0.32 | 0.05 |
| 7 | 0.84 | 0.28 | 0.13 | 0.08 |
| 8 | 1.22 | — | 0.18 | 0.07 |
| 9 | 0.76 | 0.4 | 0.12 | 0.09 |
| 10 | 0.96 | 0.3 | 0.11 | 0.05 |
| 11 | 0.78 | 0.28 | 0.13 | 0.13 |
| 12 | 0.62 | 0.32 | 0.08 | 0.1 |
| 13 | 0.78 | 0.2 | 0.13 | 0.08 |
| 14 | 0.78 | 0.38 | 0.13 | 0.05 |

After completion of the 14 cycles, the surface roughness of each disc was determined by utilizing a standard surface analyzer available under the trade designation Model QHD Bendix Profilometer to determine the Surface Waviness Factor (designated "SWF" hereinafter). It is calculated as follows:

$$SWF = \frac{\text{measured surface roughness cutoff at 2.55 mm}}{\text{measured surface roughness cutoff at 0.25 mm}}$$

Surface waviness factor is the roughness height measured at roughness-width cutoff of 2.55 mm divided by the roughness height measured at 0.25 mm roughness-width cutoff, where the roughness height is the arithmetical average deviation of roughness height expressed in microns measured normal to the center line and where roughness-width cutoff is the greatest spacing of repetitive surface irregularities to be included in the measurement of average roughness height. Lower surface waviness factors indicate more level and desirable surfaces which are more suitable for polishing to a mirror finish.

The results were as follows:

TABLE II

| Example | Product Type | Waviness Factor |
|---|---|---|
| Control 1 | set up disc | 1.36 |
| Control 2 | coated abrasive | 1.30 |
| Control 3 | nonwoven abrasive | 1.49 |
| Example 1 | fibrous matrix with abrasive agglomerates | 1.18 |

It will be observed that the product according to the present invention of Example 1 had the lowest waviness factor of 1.18.

Additional testing was done with the Schiefer abrasiveness tester, except employing a 9.1 kg weight instead of the 4.5 kg weight to determine whether or not the additional force would cause the coated abrasive to increase its cut rate. Control 1 was omitted and Control 4 described below added and the test was shortened to five 3000 revolutions cycles. The abrasive products tested are shown in Table III.

TABLE III

| Example No. | Abrasive Type | Trade Designation |
|---|---|---|
| Control 2 | coated abrasive | 3M Type "C" coated abrasive (120 grit aluminum oxide) |
| Control 3 | nonwoven | 3M "Scotch-Brite" cutting and polishing nonwoven abrasive disc (180 grit aluminum oxide) |
| Control 4 | nonwoven | 3M "Scotch-Brite" Clean N'Strip nonwoven abrasive disc (36 grit silicon carbide) |

After each 3000 revolutions cycle, the surface roughness was measured, the surface waviness factor calculated and workpiece weight loss determined. From that data, the total cut or weight loss and the SWF after the 5 cycles was calculated. Results are shown in Table IV.

TABLE IV

| Example No. | Cut (grams) | SWF |
|---|---|---|
| Control 2 | 2.42 | 1.22 |
| Control 3 | 0.79 | 2.6 |
| Control 4 | 1.94 | 4.08 |
| Example 1 | 10.54 | 1.47 |

As can be observed, the product of the present invention had a significantly higher total cut and produced a significantly more level surface than any other products tested in this group, except Control 2 which had a much lower cut but a lower surface waviness factor.

The steel disc that had been abraded with Control 4, which had a waviness factor of 4.08, was employed as the steel workpiece with the disc of Example 1 in the Schiefer test. After 100 revolutions, the waviness factor was reduced to 2.32, after an additional 100 revolutions to 1.99, and after an additional 200 revolutions to 1.69, showing the rapid cut rate and the unique surface leveling obtainable with the product of the present invention.

EXAMPLES 2–3

| Coating Composition | |
|---|---|
| Ingredients | Parts by Weight |
| polyurethane prepolymer (available under the trade designation "Adiprene" BL-16) | 3400 |
| methylene dianiline | 410 |

-continued

| Coating Composition | |
|---|---|
| Ingredients | Parts by Weight |
| amino functional silane (available under the trade designation "Z 6020" from the Dow Corning Corp.) | 88 |
| solvent (available under the trade designation "Cellosolve" acetate) | 3100 |

The ingredients set forth above were blended and mixed with additional solvent to reduce the viscosity to 75 cps. The diluted mixture was dropped onto the Bonded Nonwoven Web described in Example 1 through a dropping device consisting of 77 No. 22 1½ inch long syringe needles spaced 6 mm on centers over a width of 480 mm, with the coating composition being supplied by a positive displacement pump through a common manifold.

The needles were positioned above the conveyor with the needles pointing downward and at an angle of 45° with respect to the direction of web travel. The resin-coated web was conveyed under the needles on a paper carrier at the rate of 1.5 mm per minute and the pump adjusted so that the drops were spaced 1.5 to 3 mm apart in the direction of travel. The resin drops penetrated into the web slightly, substantially retaining their shape and encapsulating filaments in the areas within the web in which they were located. Thereafter 50 grit (300 micron average particle size) aluminum oxide mineral was dropped onto the resin-containing web to impregnate the resin droplet with the abrasive mineral, with the balance of the mineral falling through the web. The web was then cured in a 185° C. oven. The web, hereinafter referred to as "Web 2", contained 265 g of dry resin and 1390 g mineral per $m^2$. The resulting agglomerates had a major dimension of approximately 5 mm and were roughly spherical in shape.

In the same manner agglomerates were introduced into a similar second web on both sides by first treating one side and then inverting the web and treating the other side to provide a web hereinafter referred to as "Web 3" having a coating weight of 240 g of resin (dry) and 1265 g of abrasive per $m^2$ on the first side and 240 g of resin (dry weight) and 1500 g of mineral per $m^2$ on the second side.

An abrasive wheel hereinafter referred to as "Example 2" was prepared by first cutting eight 230 mm diameter discs having 16 mm diameter center holes of Web 2 and one disc of Bonded Nonwoven Web as described above with the eight discs directed with their agglomerate-impregnated surfaces in the same direction and the Bonded Nonwoven Web overlying the agglomerate-impregnated surface of the end disc, placing the cut discs on an arbor and dipping the discs in a solution consisting of 12 parts ketoxime-blocked polyurethane prepolymer (available under the trade designation "Adiprene" L-315 blocked with methylethyl ketoxime), 1.8 parts methylene dianiline and 7.7 parts 2-ethoxy-ethyl acetate solvent (available under the trade designation "Cellosolve" acetate). The discs were then rotated on the arbor at 800 rpm to remove excess resin, leaving a dry add on resin weight of 8.7%. The discs were then pressed to a thickness of 25 mm and partially cured under pressure for one hour at 135° C. and completely cured, after removal from the press, by heating at 130° C. for an additional hour. When cooled, the wheel was die cut to provide a diameter of 215 mm with a 32 mm center hole.

A second wheel, hereinafter referred to as "Example 3", was prepared in the same manner utilizing six 230 mm diameter discs of Web 3 by placing the discs on an arbor, dipping the discs into a mixture containing 10.4 parts ketoxime-blocked polyurethane prepolymer (available under the trade designation "Adiprene" L-315 blocked with methylethyl ketoxime, 4.5 parts 35% methylene dianiline in 2-ethoxy-ethyl acetate solvent (available under the trade designation "Cellosolve" acetate) and 0.4 parts lithium stearate, spinning the discs to remove excess adhesive mixture and pressing to a 25 mm thickness and curing by heating in a press for 45 minutes and then without pressure in an oven at 105° C. for 5 hours.

Wheel Examples 2 and 3 were evaluated for abrasiveness against a commercially available nonwoven abrasive 25 mm by 200 mm wheel (hereinafter designated "Control 5") available from the 3M Company under the registered trademark "Scotch-Brite" Cutting and Polishing Wheel, coarse grade having 50 grit (average particle size 300 microns) aluminum oxide abrasive. The test involved employing a floor stand polishing lathe which rotated the wheel against the 50×350 mm face of a 6 mm thick 1018 cold rolled steel workpiece which was by means of an attachment fastened to the lathe and forced against the peripheral surface of the wheel at a controlled constant force between the wheel and the workpiece while the workpiece was oscillated 150 mm in the vertical direction and 6 mm in the horizontal direction at a frequency of 50 and 25 cycles per minute respectively and while maintaining the wheel at a constant surface speed throughout the 12 minute cycles. The preweighed workpiece was weighed after each 12 minute cycle to determine the weight loss and the 12 minute abrading operation was repeated for the number of cycles set forth in Table V. The surface temperature of the workpiece was measured after each cycle. For the samples noted in Table V, the surface speed was maintained at 1525 meters per minute and the force at 6.8 kg. Results are shown in Table V below.

TABLE V

| Wheel | Cycle | Cut/12 min. (g) | Workpiece Temperature (°C.) |
|---|---|---|---|
| Control 5 | 1 | 4.7 | 195 |
| | 2 | 5.6 | 190 |
| | 3 | 4.7 | 195 |
| | 4 | 4.1 | 195 |
| Example 2 | 1 | 13.8 | 195 |
| | 2 | 13.4 | 187 |
| | 3 | 13.8 | not measured |
| | 4 | 13.4 | 195 |
| Example 3 | 1 | 42.8 | 225 |
| | 2 | 50.0 | 215 |
| | 3 | 53.6 | 225 |
| | 4 | 57.0 | 215 |

As can be seen, the cut of the abrasive agglomerate-containing wheels is considerably higher than that of conventional lofty, nonwoven abrasive product.

EXAMPLES 4–6

Three webs were produced, each utilizing the Bonded Nonwoven Web described above coated with resin and abrasive to provide substantially the same coating weight in each. The coating resin was a thermosetting phenol-formaldehyde resin. The abrasive mineral was 100/150 grit (average particle size 125 microns) aluminum oxide mineral. The resin was mixed with diethylene glycol monoethyl ether solvent (available under the trade designation "Carbitol") to reduce viscosity as required for the particular coating operation. The mineral to resin solids ratio was 1 part resin to 2.1 parts mineral.

Two of the abrasive webs, hereinafter respectively referred to as "Web 4" and "Web 5" were made employing conventional methods as taught by U.S. Pat. No. 2,958,593, to produce a nonwoven abrasive product. Web 4 was made by spraying 1:2.1 (solids ratio) resin:abrasive slurry onto the Bonded Nonwoven Web. Web 5 was made by first roll coating the resin onto the Bonded Nonwoven Web and, while the resin coating was still tacky, drop coating abrasive mineral particles on the coated web. The third web, hereinafter referred to as abrasive "Web 6", was made by applying drops of liquid resin to the Bonded Nonwoven Web in discrete, spacially separated droplets through the dropping device described in Examples 2 and 3 and drop coating mineral onto the droplet-containing web while the droplets were still tacky to provide discrete aggregates of resin and mineral.

All of the webs, after coating, were cured at 165° C. for the following time in minutes, Web 4-10, Web 5-3, and Web 6-15. The dry add on weight in grams per meter$^2$ was as follows: Web 4-1165, Web 5-1260 and Web 6-1165.

Discs having a diameter of 230 mm with a center opening having a diameter of 16 mm were cut from each of the webs and converted to wheels. In each case, 8 discs were placed on an arbor, dipped into the polyurethane prepolymer coating solution described in Examples 2 and 3, spun at about 800 rpm to remove excess resin, pressed to a thickness of 25 mm, cured in a press at 130° C: for one hour and then removed from the press and cured in an oven heated at 140° C. for 2½ hours. After cooling, the center openings were cut to 32 mm and the wheels hereinafter respectively referred to as "Wheel 4", "Wheel 5" and "Wheel 6", weighed respectively in grams as follows: 352, 375, 355.

The wheels were tested for abrasiveness utilizing the polishing lathe as described above. The wheel speed was adjusted to 1525 surface meters per minute and each wheel was tested for a 2 minute period with a 2.3 kg force applied and the metal removed from the workpiece measured after each 2 minute abrading operation. The same wheel was tested under an applied force of 4.5 kg, 6.8 kg and 9.1 kg in the same manner. A new workpiece was applied after each 2 minute abrading test. The weight loss of the wheel was also determined after each 2 minute abrading test and the abrading efficiency calculated. The abrading efficiency is the ratio of the weight loss of the workpiece divided by the weight loss of the wheel during that abrading operation. The waviness factor, as described above, was also determined after each 2 minute abrasion test.

Results are shown in Table VI.

TABLE VI

| Wheel No. | Force (kg) | Grams Metal Removed | Efficiency | W.F. |
|---|---|---|---|---|
| 4 | 2.3 | nil | nil | nil |
| 4 | 4.5 | 0.05 | 5 | nil |
| 4 | 6.8 | 1.3 | 6.5 | 1.66 |
| 4 | 9.1 | 2.2 | 5.5 | 1.61 |
| 5 | 2.3 | nil | nil | nil |
| 5 | 4.5 | 0.1 | 0.5 | 1.69 |
| 5 | 6.8 | 1.1 | 5.5 | 1.58 |

TABLE VI-continued

| Wheel No. | Force (kg) | Grams Metal Removed | Efficiency | W.F. |
|---|---|---|---|---|
| 5 | 9.1 | 1.4 | 3.5 | 1.64 |
| 6 | 2.3 | 0.8 | 4 | 1.33 |
| 6 | 4.5 | 1.6 | 4 | 1.37 |
| 6 | 6.3 | 3.7 | 9.25 | 1.36 |
| 6 | 9.1 | 5.0 | 5.55 | 1.51 |

Abrasive Webs 4, 5 and 6 were die cut to form 230 mm diameter discs which were dipped into a polyurethane prepolymer solution described above and spun as described above to remove excess resin and cured by heating as described above. The discs hereinafter respectively referred to as "Disc 4", "Disc 5", and "Disc 6", were then tested for abrasiveness in a Schiefer Tester employing a new 1018 cold rolled steel disc workpiece with a 2.3 kg force between the test disc and the steel disc for a total of 2,000 revolutions to determine the weight of steel removed during the 2,000 revolutions cycle. The 2,000 revolutions cycle was repeated for a total of three times for each test disc. The waviness factor was determined after each 2,000 revolutions cycle had been completed. Results are shown in Table VII below.

TABLE VII

| 2000 Rev. Cycle No. | Disc No. | Metal Removed (grams) | W.F. |
|---|---|---|---|
| 1 | 4 | 0.31 | 2.27 |
| 2 | " | 0.01 | 2.95 |
| 3 | " | 0.06 | 2.95 |
| 1 | 5 | 0.27 | 1.89 |
| 2 | " | 0.19 | 1.89 |
| 3 | " | 0.14 | 1.89 |
| 1 | 6 | 0.75 | 1.36 |
| 2 | " | 0.44 | 1.34 |
| 3 | " | 0.44 | 1.52 |

The abrasiveness testing with the Schiefer Tester was repeated except the force between the test disc and the steel disc was changed to 6.8 kg.

Results are shown in Table VIII.

TABLE VIII

| 2000 Rev. Cycle No. | Disc No. | Metal Removed (grams) | W.F. |
|---|---|---|---|
| 1 | 4 | 1.06 | 1.96 |
| 2 | " | 0.58 | 2.05 |
| 3 | " | 0.47 | 1.83 |
| 1 | 5 | 0.97 | 1.47 |
| 2 | " | 0.46 | 1.49 |
| 3 | " | 0.29 | 1.44 |
| 1 | 6 | 1.81 | 1.3 |
| 2 | " | 1.58 | 1.29 |
| 3 | " | 1.43 | 1.27 |

The size of the abrasive agglomerates of abrasive webs 4, 5, and 6 was determined by burning off the fibers of 77 cm$^2$ segments of each of the webs in a 480° C. oven for approximately 10 minutes, leaving only the phenolic resin and abrasive mineral. The residual of each web was vibrated gently to remove sharp edges, and seived through a series of progressively smaller screens. Table IX shows the percentage of agglomerates in each size range as compared to the particle size distribution of the 100–150 grit (125 micron) abrasive granules used to make the agglomerates.

TABLE IX

| Sieve Opening (microns) | 100–150 Grit Aluminum Oxide Particles | % Retain | | |
|---|---|---|---|---|
| | | Web 4 | Web 5 | Web 6 |
| 6730 | — | — | — | 9.8 |
| 4760 | — | — | — | 78.1 |
| 2380 | — | — | — | 3.6 |
| 1680 | — | 0.9 | 0.3 | 0.5 |
| 1190 | — | 2.9 | 4.0 | 0.5 |
| 710 | — | 18.9 | 21.4 | 4.6 |
| 590 | — | 23.2 | 20.4 | 0.9 |
| 300 | — | 26.1 | 23.3 | 0.5 |
| 210 | — | 15.5 | 17.9 | 0.3 |
| 150 through 150 | — | 6.3 | 6.9 | 0.3 |
| 175 | 2 | — | — | — |
| 125 | 41 | — | — | — |
| 100 | 26 | — | — | — |
| 90 through 90 | 17 | — | — | — |
| | 14 | — | — | — |

EXAMPLE 7

A mat of coiled integrated nylon-6 fibers having a weight of 92 grams per $m^2$, a filament diameter of 280 microns and a thickness of 16 mm made according to the disclosure of U.S. patent application Ser. No. 847,922, filed Nov. 11, 1977, was roll coated with a urethane prepolymer resin solution consisting of 8.9 parts blocked polyurethane prepolymer (available under the trade designation "Adiprene" BL-16), 2.9 parts a 35% solution of methylene dianiline in 2-ethoxy-ethyl acetate solvent (available under the trade designation "Cellosolve" acetate), 0.177 parts amino functional silane (available under the trade designation Z6020 from the Dow Corning Co.), and 1.4 parts xylol. Porous abrasive-containing resin spheres larger than 12 mesh and smaller than 6 mesh (average particle size 1.5 to 3.5 mm), made by dropping granular phenolic resin (available under the trade designation "Varcum" 5485) into hot* tumbling 50 grit (average particle size 300 micron) $Al_2O_3$. The resultant abrasive-containing spheres, containing 91% mineral and 9% phenolic resin, were dropped into the adhesive-coated web which was then cured at 150° C. for 6 minutes. The resultant coated web contained 2,430 grams per $m^2$ abrasive spheres and 30 grams per $m^2$ polyurethane resin. The web was then sprayed first on one side and then on the other side with an adhesive mixture consisting of 7.7 parts blocked polyurethane prepolymer (available under the trade designation "Adiprene" BL-16), 2.5 parts of a 35% solution of methylene dianiline in 2-ethoxy-ethyl acetate, 0.008 parts amino functional silane (Z6020), 0.61 parts of a mixture of 50% lithium stearate in 50% solvent (available under the trade designation "Cellosolve" acetate), and 2.5 parts xylol, resulting in a dry coating weight of 400 grams per $m^2$ on one side and 500 grams per $m^2$ on the other side.

*200°–315° C.

Nine 230 mm diameter discs having 16 mm diameter center holes were cut from the abrasive coated web, placed on an arbor, and dipped in the same adhesive composition to bond the spheres to the web. The discs were spun at 300 rpm to remove excess resin and the nine discs were compressed to 28 mm in a heated press at 140° C. for one hour and removed from the press and heated an additional hour at 135° C. to produce a wheel hereinafter referred to as "Example 7".

The resultant abrasive wheel was evaluated for abrasiveness against a commercially available low-density abrasive wheel made by the assignee of the present application and sold under the trade designation "Scotch-Brite" brand Cutting and Polishing coarse wheel containing 50 grit (300 micron) $Al_2O_3$ abrasive mineral hereinabove referred to as "Control 5". The wheels were evaluated on the polishing lathe described above rotating at 1525 surface meters per minute with a 9.1 kg force for four 12 minute test periods, using a new workpiece for each test. The surface temperature of the workpiece was monitored at the center of the abrading area and the amount of metal cut from the workpiece was measured. Results are reported in Table X below.

TABLE X

| Wheel | Test | Cut/12 Min. (g) | Temperature of Workpiece (°C.) |
|---|---|---|---|
| Control 5 | 1 | 7.59 | 220 |
| | 2 | 8.11 | 223 |
| | 3 | 8.28 | 226 |
| | 4 | 7.51 | 226 |
| Example 7 | 1 | 14.0 | 188 |
| | 2 | 17.0 | 190 |
| | 3 | 17.85 | 202 |
| | 4 | 17.7 | 202 |

EXAMPLE 8

The Bonded Nonwoven Web described above was conveyed at 1 meter per minute under the needle manifold dropping device described above. In this case all of the needles were bent and secured so that two adjacent needles would deposit one combined drop of resin into the same location on the bonded web. The resin consisted of 10 parts 73% solids base catalyzed thermosetting phenol-formaldehyde resin, 0.2 parts of a 50% aqueous sodium hydroxide solution and 2-ethoxy-ethanol solvent (available under the trade designation "Cellosolve") to reduce the viscosity to 150 cps. About 270 grams per $m^2$ of cured resin was applied in enlarged drops spaced about 9 mm apart in the cross direction and about 9 mm apart in the machine direction.

The droplet-coated web supported on a paper carrier was then passed under a mineral dropping device which had two application stations with the second station directly over a series of four 25 mm square bars rotating at 375 rpm. At the first mineral dropping station, porous abrasive spheres of 50 grit aluminum $Al_2O_3$ were dropped onto the liquid resin droplets. These porous spheres were made by dropping 30–40 mesh granules of phenolic resin (available under the trade designation "Varcum" 5485) into heated 150 grit aluminum oxide particles contained in a 105°–135° C. heated rotary kiln and then adding calcium carbonate to the rotary kiln. The resultant porous abrasive spheres contained 28% phenolic resin, 43% aluminum oxide mineral and 37% calcium carbonate. At the second mineral dropping station, 180 grit (85 micron) $Al_2O_3$ individual particles were dropped onto the web. The rotating square bars caused the abrasive particles and the porous abrasive spheres that had passed through the web and were laying on the paper carrier to re-enter the web. Some of these particles and spheres adhered to the resin droplets which already contained some abrasive material. At the first mineral dropping station, 1150 grams per $m^2$ of the 150 grit (100 micron) porous spheres were added. At the second mineral dropping station, 400 grams per $m^2$ of the 180 grit particulate mineral were added. The web was then cured by heating in an oven at 150° C. for 7 minutes. The resulting agglomerates had a major dimension of approximately 6 mm and were roughly spherical in shape.

EXAMPLE 9

The resin-mineral slurry was prepared of the following ingredients:

| Ingredients | Parts by Weight |
|---|---|
| Base catalyzed thermosetting phenol-formaldehyde resin (73% solids) | 13.6 |
| 50% Aqueous sodium hydroxide solution | 0.3 |
| 2-ethoxy ethanol solvent (available under the trade designation "Cellosolve" | 11.8 |
| Colloidal silica (available under the trade designation "Cab-O-Sil" M-5 from the Cabot Corp.) | 0.7 |
| Aluminum oxide mineral (Grit 180, average particle size 85 micron) | 40.9 |

The slurry was formed into droplets with a coating device of the type depicted in FIG. 5 consisting of a 290 mm diameter perforated screen cylinder having 5 mm diameter holes spaced 3 mm from each other in a staggered pattern and being fitted with a flexible doctor blade on the inside and near the bottom of the cylinder. The doctor blade forced the slurry into the holes and onto a web passed therebelow. The slurry was supplied to the inside of the cylinder through a hollow shaft upon which the perforated screen cylinder rotates.

The mixed slurry was placed in a pressure tank with an agitator, air pressure was utilized to force the slurry inside the perforated screen cylinder, while passing the Bonded Nonwoven Web described above therebelow at 9 meters per minute while rotating the perforated screen cylinder to produce cylindrical shaped agglomerates approximately 6 mm long and 3 mm in diameter at a coating weight of 1015 g per $m^2$. The resin was then cured in an oven heated at 150° C. for 7 minutes.

The coated and dried webs of Examples 8 and 9 were converted into convolute wrapped and reinforced wheels hereinafter designated as "Wheel 8" and "Wheel 9" respectively. A one-shot polyether flexible polyurethane foam was used to bind the convolute wound wheels together. Wheel 8 had a density of 0.78 g per cc and wheel 9 had a density of 0.73 g per cc. The wheels were approximately 200 mm in diameter and 100 mm wide and had a 75 mm center hole with a core.

Wheels 8 and 9 were evaluated in a "Clair" Double Head Polisher, Model 7302, a commercial device used for preparing knife blades for final buffing. The device includes 2 parallel shafts rotatable in opposite directions at the same speed aligned with one above the other. In use, a 200 mm diameter 100 mm wide abrasive wheel having a 75 mm center hole was mounted on each shaft with the peripheral edges of the wheels in contact while being forced together with a 9.5 kg force to provide a contact zone between the wheels. While rotating the wheels in opposite directions at 1750 rpm, a 200 mm long 30 mm wide 2 mm thick steel knife blade was introduced lengthwise into wheel contact zone and the knife blade was moved in a 150 mm 3 second in-out cycle for a total of 20 times and moved side by side 20 mm for 40 cycles for a one minute run.

Wheels 8 and 9 were evaluated against "Control 6", a "Scotch-Brite" Brand Cutting and Polishing medium grade wheel which contains grade 100 aluminum oxide (having an average particle size of 150 micron), and "Control 7", prepared by coating the periphery of a cotton buffing wheel with an animal hide glue solution, coating the glue-coated periphery with IF grit Turkish Emery abrasive particles (having an average particle size of 50 microns), allowing glue to dry, repeating coating and drying steps several times, and fracturing the resultant dried peripheral coating into small segments by beating with a hammer.

The waviness factor and amount of metal cut were determined and are recorded in Table XI below. In each test sequence, one of the two wheels was "Control 6" and the other the designated test wheel. The result reported for "Control 6" is the total cut for both sides of the blade divided by 2. That is, the total cut was 0.66 g for both sides, which divided by 2 would give 0.33 g for one side. The "cut" for the other wheels reported in Table XI is the total cut minus 0.33 g since one wheel was "Control 6" for each test.

TABLE XI

| Wheel | W.F. | Cut (g) |
|---|---|---|
| Control 6 | 1.65 | 0.33 |
| Control 7 | 1.39 | 1.35 |
| Wheel 8 | 1.20 | 2.74 |
| Wheel 9 | 1.15 | 1.77 |

We claim:

1. A method of making an abrasive article, said method comprising the steps of forming within a lofty web comprising undulated filaments bonded at points of mutual contact by depositing in a pattern with an appropriate printing or extruding device a plurality of separated agglomerates formed of a mixture of uncured liquid curable bonding agent and abrasive particles, said agglomerates having an average particle size of at least 2 mm to provide an agglomerate-impregnated web; and curing said bonding agent to convert said agglomerates to abrasive agglomerates comprising abrasive particles bonded together with said bonding agent, said bonding agent and said abrasive particles being selected to provide an abrasive particle to bonding agent weight ratio of about 1:1 to 20:1.

2. The method of claim 1 also including the steps of cutting segments of the agglomerate-impregnated web to a desired size, stacking the cut segments to form an assembled pile, contacting the assembled pile under pressure with a compacting force, adhering the compacted pile together in a manner which permits retention of the compacted shape after removal of the compacting force, and removing the compacting force.

3. The method of claim 2 also including the step of forming a wheel of said compacted pile.

* * * * *

UNITED STATES PATENT AND TRADEMARK OFFICE

CERTIFICATE OF CORRECTION

PATENT NO. : 4,486,200

DATED : December 4, 1984

INVENTOR(S) : RAYMOND F. HEYER and WILLIAM R. LOVNESS

It is certified that error appears in the above-identified patent and that said Letters Patent is hereby corrected as shown below:

Col. 2, line 8, "produce" should read --provide--.

Col. 6, line 33, "100 microns" should read --1000 microns--.

Col. 8, line 29, "a, hereinafter" should read --a web, hereinafter--.

Signed and Sealed this

*Twenty-eighth* Day of *May 1985*

[SEAL]

*Attest:*

DONALD J. QUIGG

*Attesting Officer*

*Acting Commissioner of Patents and Trademarks*